United States Patent [19]

Jozwiak

[11] 4,183,482

[45] Jan. 15, 1980

[54] NIGHT GUIDING DEVICE FOR SELF-PROPELLED MISSILES

[75] Inventor: Joseph E. Jozwiak, Paris, France

[73] Assignee: Societe Anonyme de Telecommunications, France

[21] Appl. No.: 746,944

[22] Filed: Dec. 2, 1976

[30] Foreign Application Priority Data

Dec. 9, 1975 [FR] France ..... 75 37631

[51] Int. Cl.[2] ..... F42B 15/10; F41G 1/36; F41G 1/32

[52] U.S. Cl. ..... 244/3.16; 250/338; 250/342; 244/311

[58] Field of Search ..... 244/3.16, 3.13, 3.11; 250/338, 342

[56] References Cited

U.S. PATENT DOCUMENTS

| | | | |
|---|---|---|---|
| 3,672,607 | 6/1972 | Stauff et al. | 244/3.16 |
| 3,974,383 | 8/1976 | Chapman | 250/342 |
| 3,992,629 | 11/1976 | Chapman | 244/3.16 |
| 4,027,159 | 5/1977 | Bishop | 250/342 |
| 4,034,949 | 7/1977 | Hoesterey et al. | 244/3.16 |

*Primary Examiner*—Samuel W. Engle
*Assistant Examiner*—Thomas H. Webb
*Attorney, Agent, or Firm*—Jacobs & Jacobs

[57] ABSTRACT

A device for guiding by night self-propelled missiles, comprising a daylight sighting telescope and an infrared goniometer which in association are called here daylight localizing apparatus, for spotting an infrared source carried by the missile, and a thermal telescope for night vision, to which are associated an infrared detector and a display member, further comprising a thermal reticle, optical means for forming outside the daylight localizing apparatus the image of the daylight telescope reticle, means for shifting the daylight telescope reticle image so that it coincides with the thermal reticle, optical means for forming the thermal reticle image on the thermal telescope detector, and an adequate frame mechanically attached to the daylight localizing apparatus for supporting said means, said thermal reticle, the thermal telescope and its associated detector and display member.

8 Claims, 6 Drawing Figures

NIGHT GUIDING DEVICE FOR SELF-PROPELLED MISSILES

Opto-electronic devices are known, called localizing apparatuses, for the daylight guidance of self-propelled missiles towards a mobile or stationary target.

Such devices comprise a sighting telescope operating in the visible wave-lengths for an observer to see the image of the target and its environment in a plane containing a reticle providing for the optical axis of said telescope, and an infrared goniometer operating in the spectral band of 1.5 to 2.5$\mu$ and delivering at each moment the coordinates of the missile measured in relation to the optical axis of said goniometer. By mechanical construction followed by an optical adjustment, the optical axis of the daylight sighting telescope and the goniometer have been aligned, i.e. one point whose image sits in the center of the daylight sighting telescope reticle is also located on the goniometer optical axis. This alignment is achieved with an accuracy superior to 0.1 mrd.

When such localizing apparatuses are to be used by night, they have to operate in association with an infrared sighting telescope, also called thermal telescope, operating in the 3 to 5$\mu$ wave-length area or in the 8 to 12$\mu$ wavelength area, that is, capable to supply in association with a display device the thermal image of the target and its environment. When used for the guidance of missiles in association with the goniometer of the localizing apparatus, said thermal image has to be spotted by a reticle materializing the optical axis of the thermal telescope, said optical axis having to be aligned with the optical axis of the infrared goniometer or, and this amounts to the same, with the optical axis of the daylight sighting telescope.

To this effect, the localizing or daylight and night guiding device according to the invention comprises a thermal reticle and optical means for aligning the optical axis of the night sighting telescope with the optical axis of the daylight sighting telescope, that is optical means for forming outside the daylight localizing apparatus the image of the daylight sighting telescope reticle, means for shifting the image of the daylight telescope reticle and placing it in coincidence with the thermal reticle, optical means for forming the image of the thermal reticle on the detector of the thermal telescope, and an appropriate frame mechanically fixed on the daylight localizing apparatus for supporting said means, said thermal reticle, said thermal telescope with its associated detector and visualization device.

The display device associated with the thermal telescope represents then in the same plane the image of the target and its environment and the image of the thermal reticle.

An alternative device according to the invention comprises optical means necessary for the eye of the observer to see the display screen through the eyepiece of the daylight sighting telescope.

In this alternative, the observer keeps an eye looking through the daylight sighting telescope eyepiece in order on the one hand to bring about coincidence of the visible and thermal reticles and on the other hand to follow the movements of the target with the crossing point of the thermal reticle.

In an alternative embodiment, the display device is seen through an eyepiece belonging to it. In this case, the observer looks through the daylight sighting telescope eyepiece to bring about coincidence of the visible and thermal reticles, and then looks through the observation eyepiece of the display device to follow the movements of the target with the crossing point of the thermal reticle.

In all cases, the target is followed by moving the optical channels which are mechanically secured to each other.

An embodiment of the device according to the invention will be described further and only by way of example, reference being made to the accompanying drawing in which.

Figure 1:
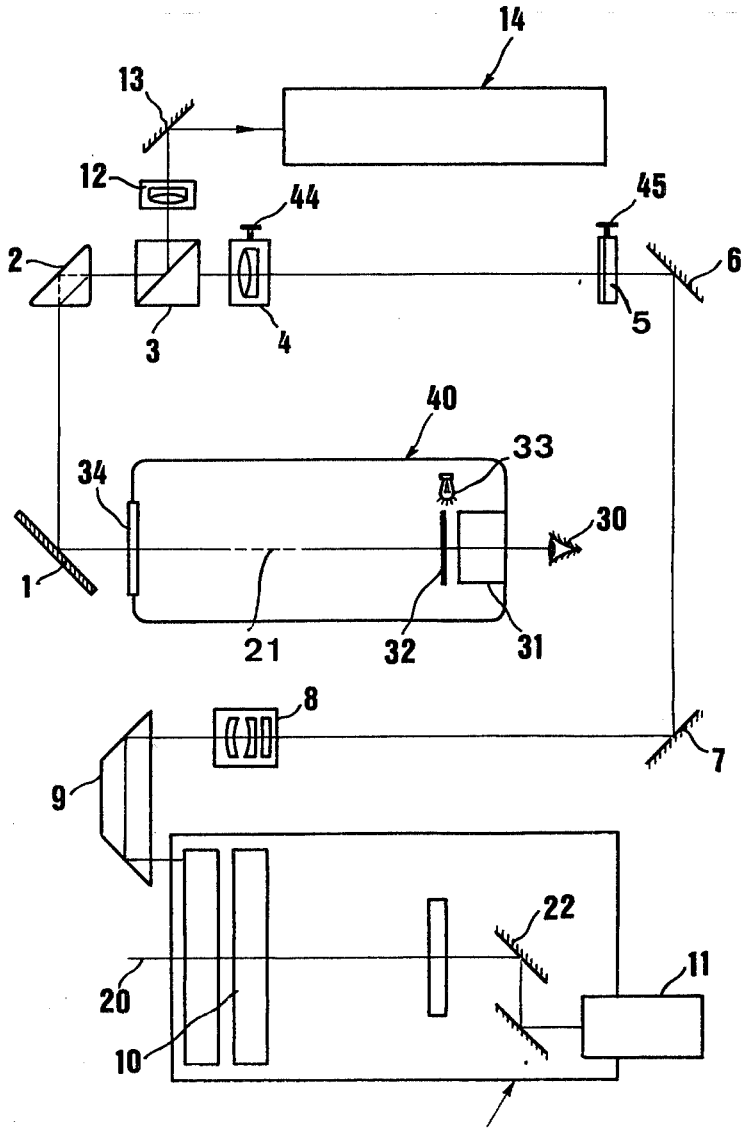
FIG. 1 is a schematic view of the various optical means and optical paths of the device, all shown in the same plane.

As may be seen in FIG. 1, the device according to the invention comprises a daylight localizing apparatus 40 which has been represented only by the daylight sighting telescope eyepiece 31 on the optical axis 21, the reticle 32 and the pupil 34. A small lamp 33 lights reticle 32. Outside the localizing apparatus 40 is mounted a dichroic plate 1 on axis 21 for reflecting the visible rays and transmitting the infrared radiation. After crossing, inter alia, pupil 34, the light rays emerging from reticle 32 reflect on plate 1 and impinges on a roof prism 2 which eventually corrects the beam deflection, a semi-reflecting separating prism 3 and a lens 4 projecting the image of the optical reticle 32 on the plane of the thermal reticle 5. Said thermal reticle receives therefore the image of the visible reticle 32 on one side, and transmits infrared radiations on the other side.

Figure 3:
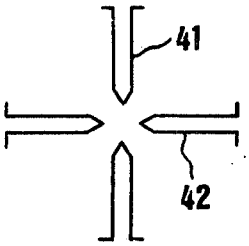
FIGS. 3 through 5 are embodiments of the thermal reticle.
Figure 4:
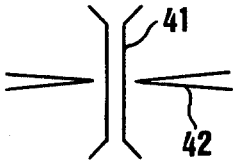
Figure 5:
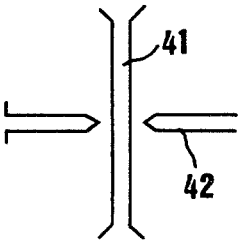
Figure 6:
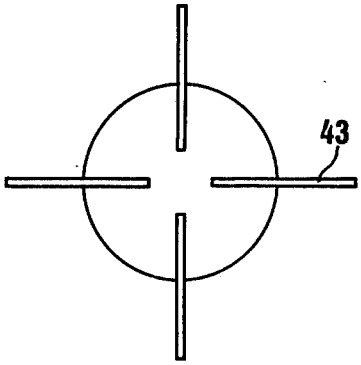
FIG. 6 is an embodiment of the optical reticle of the daylight sighting telescope associated with one of the thermal reticles of FIGS. 3 to 5.

The thermal reticle 5 is made of electrical resistances 41, 42 arranged crosswise according to lay-outs which are illustrated in three alternatives in FIGS. 3 to 5 for corresponding to the lay-out of the hairs or lines 43 of the daylight telescope optical reticle 32 as shown in FIG. 6.

Lens 4 is provided with a hand lever 44 for adjusting its shifting movements within its plane, and a thermal reticle 5 is provided with a hand lever 45 for adjusting its rotary movements. The superimposition or adjustment of the hairs or lines 43 of the optical reticle inside the intervals of resistances 41, 42 of the infrared reticle is obtained by actuating both hand levers 44 and 45.

The thermal reticle image 5 is formed on detector 11 of the thermal telescope through deflecting mirrors 6 and 7, the infrared lens 8 and the reflecting prism 9. When emerging from said reflecting prism 9, the infrared radiation coming from the thermal reticle 5 penetrates the thermal telescope lens 10, travels through scanner 22 and impinges on the infrared detector 11 eventually placed in a cryostatic unit. Said detector is sensitive within the 3 to 5$\mu$ or 8 to 12$\mu$ wave-length range.

Observation of the display screen 14, which may be a cathode ray tube, through eyepiece 31 of the daylight sighting telescope is achieved through the roof prism 2, the semi--reflecting separating prism 3 which is associated with a lens 12 positioned on its reflected beam, and a reflecting mirror 13.

Figure 2:
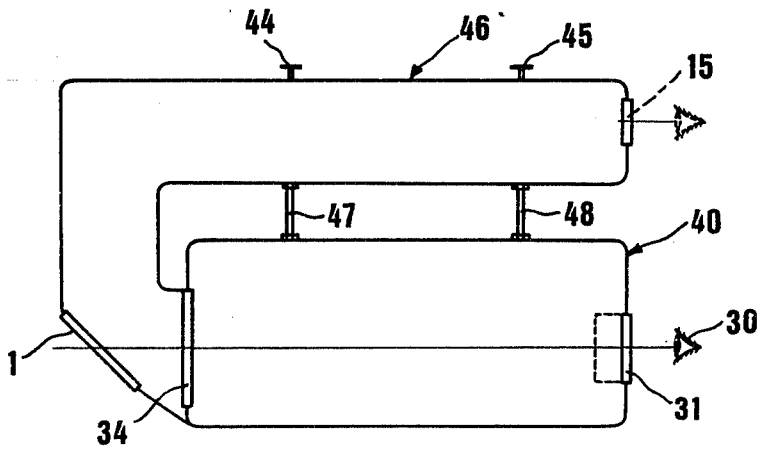
FIG. 2 is an elevation schematic view of the device.

Direct observation of the display member 14 may be possible if said device is provided with a lens 15 as shown in FIG. 2.

The various optical means 1, 2, 3, 4, 6, 7, 8, 9, 12 and 13, the thermal reticle 5 and the thermal telescope with its detector 11 and display member 14, are mounted on a frame 46 (FIG. 2) fixed by screws 47, 48 on the daylight localizing apparatus 40, while the dichroic plate 1 is mounted in a window of said frame for entrance of the infrared radiation. The arrangement on frame 46 is such that the whole unit is of minimum bulkiness. Said frame is mechanically attached to the housing 40 of the daylight localizing apparatus, and the thermal telescope optical axis 20 is positioned in the vicinity of its alignment position with the optical axis 21 of the daylight sighting telescope.

What I claim is:

1. A device for tracking by night self-propelled missiles, comprising a daylight sighting telescope provided with an optical reticle, an eyepiece and an infrared goniometer which in association are called here daylight localizing apparatus, for tracking an infrared source carried by the missile, and a thermal telescope for night vision, to which are associated an infrared detector and a display member, further comprising a thermal reticle, optical means for providing an optical path between said eyepiece and said thermal reticle to enable viewing of the thermal reticle image in said daylight telescope, and adjusting means for bringing into coincidence the image of the optical reticle of the daylight telescope with that of the thermal reticle.

2. A device according to claim 1, wherein the optical means comprises a dichroic plate, a roof prism, a separating prism and a lens.

3. A device according to claim 2, wherein the adjusting means comprises means for shifting the lens and means for rotating the thermal reticle.

4. A device according to claim 1, wherein the means for forming the image of the thermal reticle on the thermal telescope detector comprise deflecting mirrors, an infrared lens and a reflecting prism.

5. A device according to claim 1, wherein the display member comprises its own observation eyepiece.

6. A device according to claim 1, wherein optical means are further provided which are arranged for the observer's eye to see the display member through the daylight sighting telescope eyepiece.

7. A device according to claim 6, wherein said means for seeing the display member through the daylight telescope eyepiece comprise a separating prism inserted between the roof prism and the lens.

8. A device according to claim 1, comprising a frame attached to the daylight localizing apparatus for supporting said adjusting means, said thermal reticle, said thermal telescope and its associated detector and display member.

* * * * *